United States Patent [19]

Galtz et al.

[11] 4,439,095

[45] Mar. 27, 1984

[54] COMBUSTION AIR FAN

[75] Inventors: Rüdiger Galtz, Munich; Rudolf Reinhardt, Krailling, both of Fed. Rep. of Germany

[73] Assignee: Webasto-Werk W. Baier GmbH & Co., Gauting, Fed. Rep. of Germany

[21] Appl. No.: 447,186

[22] Filed: Dec. 6, 1982

[30] Foreign Application Priority Data

Mar. 18, 1982 [DE] Fed. Rep. of Germany ..... 3209904

[51] Int. Cl.[3] ..... F01D 17/00

[52] U.S. Cl. ..... 415/52; 415/53 R; 415/53 T; 415/213 T; 415/152 A

[58] Field of Search ..... 415/52, 53 R, 53 T, 415/54, 55, 56, 145, 213 T, 151, 11, 152 R, 152 A

[56] References Cited

U.S. PATENT DOCUMENTS

| | | | |
|---|---|---|---|
| 1,382,665 | 6/1921 | Myers | 415/53 |
| 3,356,034 | 12/1967 | Knowles | 415/213 T |
| 3,972,642 | 8/1976 | Fricke | 415/145 |

*Primary Examiner*—Stephen Marcus
*Assistant Examiner*—John T. Kwon
*Attorney, Agent, or Firm*—Antonelli, Terry & Wands

[57] ABSTRACT

A fan, especially for the conveyance of the combustion air in a motor vehicle heating system, provides for adjusting of its output, with an efficiency that is as high as possible, and little operating noise. The fan, which preferably is a ring-duct fan, has a by-pass duct connected in by-passing relationship to the exit of the fan, with the by-pass duct containing an adjustable throttling member. In accordance with a preferred embodiment, the by-pass duct leads back into the intake duct of the fan.

9 Claims, 4 Drawing Figures

COMBUSTION AIR FAN

BACKGROUND AND SUMMARY OF THE INVENTION

The invention relates to a fan, especially for the conveyance of the combustion air in the case of a motor vehicle heater.

Fans of this type, which frequently are ring-duct fans, supply high pressures at relatively low efficiency. Their characteristic curves are steep. Mainly, in the case of higher rotational speed, they are considerably noisy during operation.

Fans of this type are known, for example, from German Pat. No. 902 074 and German Published Patent Application No. 24 09 184. In the case of the known ring-duct fans or lateral-duct compressors, an opening is provided in the area of the impeller between the intake connection and the pressure connection, through which gas can exit, which otherwise would be pulled along from the pressure connection to the intake connection. This measure has the purpose of increasing the efficiency of such known fans. In this case, the gas exiting through the opening may either, by means of a return pipe, be directed to an intermediate point of the lateral-duct (DE-AS No. 24 09 184) or it may also be directed to the intake connection of the compressor of the fan (DE-PS No. 902 074).

The present invention has for a principal object the creation of a fan of the initially mentioned type that has a mechanism for the adjustment of its capacity, which enables the adjustment of the fan output to be performed in a manner that as little noise as possible is developed and an efficiency is achieved that is as high as possible.

According to the present invention, this object is achieved, in accordance with preferred embodiments, by provision of a by-pass duct that is connected with the conveying outlet of the fan and has an adjustable throttling member.

In contrast to the conventional output control, where a throttling member is disposed in the intake duct of the fan, the measure according to the present invention results in the following advantages: The power input of the fan rises with an increasing pressure ratio. In the case of an output by means of the throttling of the intake air, the pressure ratio is increases and, therefore, also the power input. Because of the features of the present invention, however, the pressure ratio is not increased during the reduction of the fan output, because an equalization of pressure takes place through the by-pass duct. Thus, the power input is reduced in comparison to the output control by means of the throttling of the intake air. The development of noise also increases with the pressure ratio. Since, as explained, the pressure ratio is not increased when the output of the fan of the present invention is reduced, the development of noise is also decreased in comparison to the conventional solutions.

When the fan is used in a combustion fan in heaters, the fan according to the present invention also results in the following advantage: When the point in the by-pass duct, where the throttling member is located, is clogged by dirt, this only results in an increase of the fan output. However, an increase of the fan output is harmless in regard to the production of harmful substances ($CO_2$ and CO). In the case of the conventional solution, on the other hand, where the output control takes place by means of the throttling of the intake air, dirt accumulation at the throttling point would result in a decrease of the combustion air conveyance and, thus, in an increase in the unburned, partially toxic fuel components.

Furthermore, in the case of the damming of the combustion-air intake opening of a heater according to the solution of the state of the art, where the supply of intake air is throttled, the maximally possible fan pressure accumulates at all seals and, in the case of possible small leaks, results in emissions of harmful substances. In the case of the by-pass solution according to the present invention, however, the fan pressure can reach no more than the flow resistance of the by-pass duct (which is significantly lower than the maximal fan pressure).

According to a particularly advantageous aspect of the invention, the efficiency of the fan can be further increased if the air expanding in the by-pass duct is used for admission to the fan impeller. For this purpose, it is provided that the by-pass duct leads into the intake duct of the fan.

Especially in combination with ring-duct fans, the invention is advantageous because ring-duct fans have steep characteristic curves and the adjustment of the output is, therefore, especially critical.

According to an advantageous embodiment, the throttling member in the by-pass duct consists of an adjusting screw. It is especially advantageous to use a setscrew for this purpose.

According to another advantageous embodiment of the invention, this adjusting screw may be disposed so that it also projects into both the intake duct and the by-pass duct so that, to the extent that adjustment of the screw frees the cross section of the by-pass duct, it reduces the cross section of the intake duct. Consequently, the adjustment is especially effective because the two mentioned effects are added to one another.

The efficiency of this control is greater, the closer the by-pass opening is disposed to the lateral duct of the fan, and the more directly the by-pass opening connects the pressure side with the suction of the duct. Accordingly, it is an advantageous feature of the invention to make the by-pass duct between the intake duct and the conveying outlet of the fan as short as possible.

In another development of the preferred embodiment, it is provided that the by-pass duct extends in the proximity of the lateral duct of the ring-duct fan.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
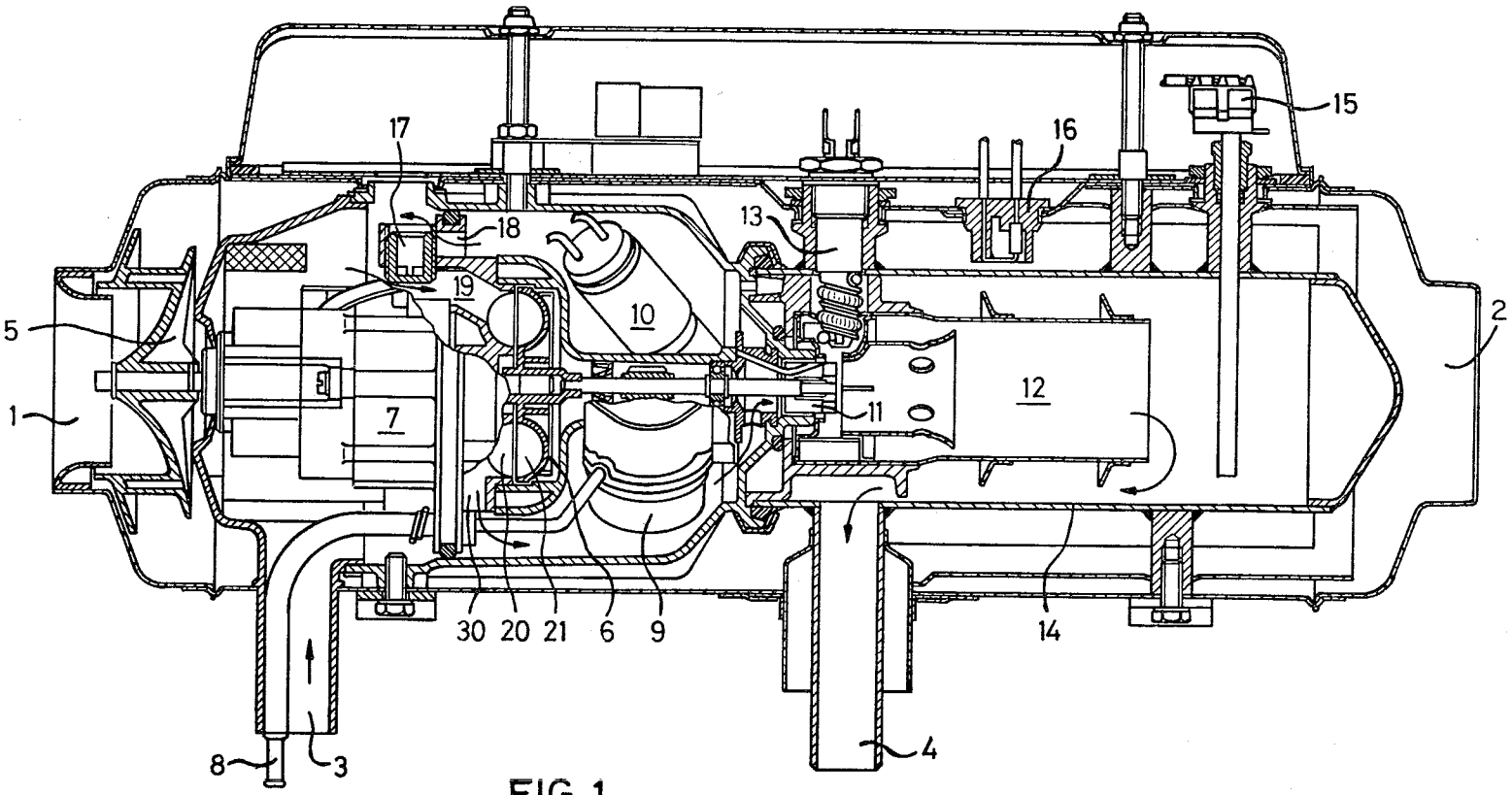
FIG. 1 shows a fan according to the invention installed in a motor vehicle heating system.

FIG. 1 shows an axial section of a heating-air fan. At the opening 1, fresh air enters into the heater, by action of the heating-air fan 5, with the heated air leaving through opening 2. The air required for the combustion is drawn in by a ring-duct fan 6 via connection pipe 3 and is directed to the burner through connection 30. By means of a fuel line 8 extending in the connection 3, the fuel is directed to the burner by means of a fuel pump 9. By means of a rotary vaporizer 11, the fuel is vaporized and ignited by a spark plug 13, whereupon it burns in a combustion chamber 12. The resulting heat, by means of the heat exchanger 14, is transmitted to the air flowing through the heater. The exhaust gases resulting from the combustion are drawn off through a connection 4. For reasons of safety, a combustion-monitoring thermostat 15, a temperature control 16, as well as a solenoid valve 10 are provided. The heating-air fan 5, the ring-duct 6, the fuel pump 9 and the rotary vaporizer 11 are driven by an electric motor 7. The ring-duct fan 6 consists of a lateral duct 20 and an impeller part 21. An air-intake duct 19, communicating with air connection pipe 3, leads into the lateral duct 20. Separately from the air-intake duct 19, the pressure connection 30 leads from the lateral duct 20. The pressure connection 30 is connected with a by-pass duct 18 leading into the intake duct 19. A setscrew 17 is provided in the by-pass duct 18 for changing the flow cross section of the by-pass duct 18.

The ring-duct fan 6 operates as follows: Driven by the motor 7, the impeller part 21 rotates around its axle, whereby the air contained in the lateral duct 20 is taken along, so that an underpressure is generated at the intake connection 19 and air is conveyed there by means of the connection 3. Compressed air exits at the pressure connection 30 of the ring-duct fan 6 and is directed to the combustion chamber 12. Depending on how far the setscrew 17 is screwed into its threaded receiving bore 22, a part of the compressed air flows back to the suction side of the ring-duct fan 6 through the by-pass duct 18, and there is, again, drawn in through the intake duct 19. By turning the setscrew 17, the total output of the fan can, therefore, be adjusted. In addition, the setscrew 17 projects into the intake duct 19. The result is that, by screwing the setscrew 17 into place, the by-pass duct 18 is, at the same time, opened increasingly, and the intake duct 19 is closed, both of which contributes to a decrease of the output of the fan 6. An unscrewing of the setscrew 17 results in an increase of the output of the fan since the intake duct is freed and the by-pass duct 18 is closed.

Figure 2:
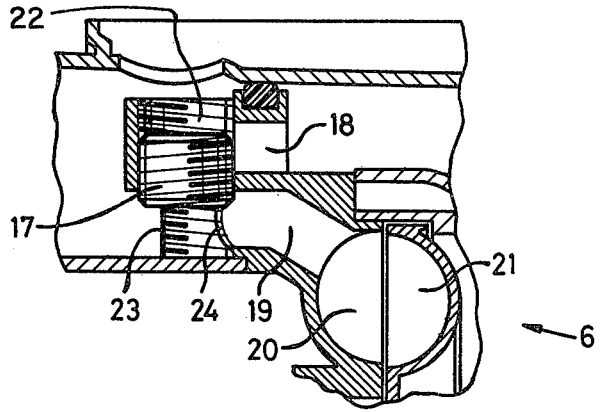
FIG. 2 shows a detail from FIG. 1 at a larger scale.

FIG. 2 shows that part of FIG. 1 that is significant for the output adjustment of the fan 6 at a larger scale. Again, the setscrew 17 can be recognized which, by means of a slot or a hexagonal recess at its top, can be screwed into a threaded bore 22. The by-pass duct 18 coming from the pressure connection of the fan 6, as well as the intake duct 19 leading to the suction connection of the fan 6, lead into the threaded bore 22. When the setscrew 17, as shown, is in a center position in the threaded bore 22, air from the pressure connection of the fan 6, by means of the by-pass duct 18, can enter the cylindrical threaded bore 22 and can leave the threaded bore again at the front side thereof (at the top of the figure), and can combine with the intake air. The intake air enters through a borehole 23 into the lower part of the bore 22 (indicated in the figure on the opposite side of the setscrew 17) and exits at the mouth point 24 into the intake duct 19. As shown clearly in FIG. 2, the screwing-into-place of the setscrew 17 opens the by-pass duct 18 increasingly, while the intake duct 19 is closed to the same extent. Thus, by the screwing-in of the setscrew 17, it moves into the intake duct 19, so that the output of the fan 6 is reduced, while, by screwing of setscrew 17 in the opposite direction, i.e., in the direction of the by-pass duct 18, the output is increased up to the maximal output.

Figure 3:
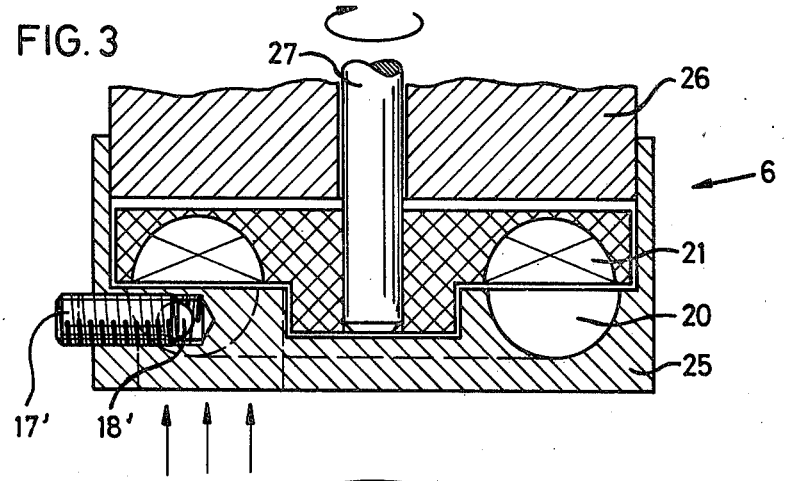
FIG. 3 shows another embodiment of a fan according to the invention in the form of an axial section.
Figure 4:
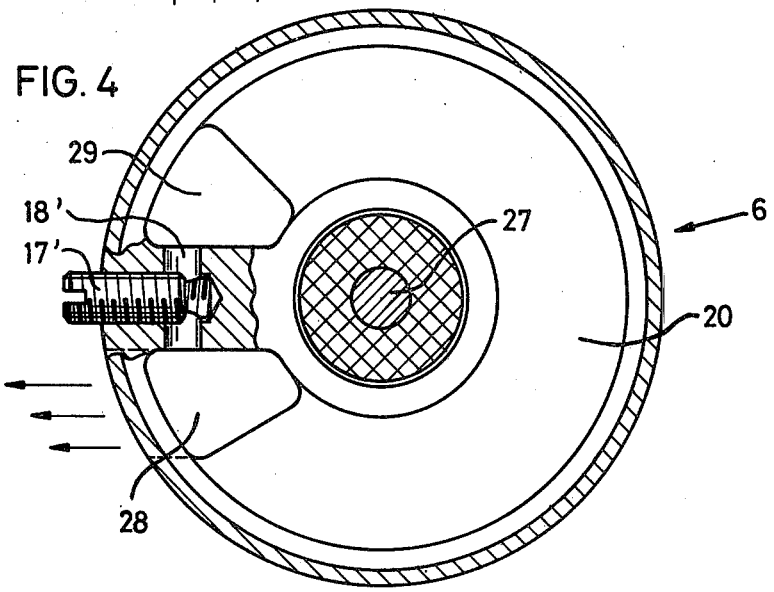
FIG. 4 shows the embodiment shown in FIG. 3 in plan view.

FIGS. 3 and 4 show another embodiment of the fan 6. The fan consists of a housing 25 which is closed by a lid 26 having a central borehole for the reception of a drive shaft 27. An impeller part having blades 21 is disposed on the shaft 27. The blades disposed in an annular groove that faces opposite a groove 20, that is semicircular in its cross section and is disposed in the floor 25 of the housing. The groove 20 is a so-called lateral duct. As shown in FIG. 4, the lateral duct 20 has a pressure connection 28 and a suction connection 29, which are separated by a barrier. The pressure connection 28 is connected by the shortest distance with the suction connection 29 through a by-pass duct 18' in the barrier. A tapped hole extends normally with respect to the by-pass duct 18' and radially with respect to shaft 27. A setscrew 17' is adjustably screwed into the tapped hole, and by the screwing-in or unscrewing of the setscrew 17', the cross section of the by-pass duct 18' is progressively changed.

While we have shown and described various embodiments in accordance with the present invention, it is understood that the same is not limited thereto, but is susceptible of numerous changes and modifications as known to those skilled in the art, and we, therefore, do not wish to be limited to the details shown and described herein, but intend to cover all such changes and modifications as are encompassed by the scope of the appended claims.

We claim:

1. A fan of the type for conveying combustion air to the burner of a motor vehicle heating system, comprising a housing, an impeller in said housing, an intake duct for delivery of air to said impeller and a discharge exit for the conveyance of air from said impeller, wherein an outlet by-pass duct is connected in by-passing relationship with respect to the discharge exit of the fan and is provided with an adjustable throttling member, whereby the output of the fan may be adjusted, wherein the throttling member is an adjusting screw which controls the flow cross section of the by-pass duct, projects into the intake duct, and is operable for controlling of the flow cross section of the intake duct in a manner opposite to its controlling of the cross section of the by-pass duct.

2. A fan according to claim 1, wherein the by-pass duct leads into the intake duct of the fan.

3. A fan according to claim 2, wherein said fan is a ring-duct fan, said housing having a lateral duct internally thereof, and said impeller having a ring-shaped duct with blades disposed so as to face opposite to said lateral duct.

4. A fan according to claim 1, wherein said fan is a ring-duct fan, said housing having a lateral duct internally thereof, and said impeller having a ring-shaped duct with blades disposed so as to face opposite to said lateral duct.

5. A fan according to claim 4, wherein the adjusting screw is a setscrew.

6. A fan according to claim 3, wherein the adjusting screw is a setscrew.

7. A fan according to claim 2, wherein the by-pass duct, between the intake duct and the discharge exit, covers a distance that is as short as possible.

8. A fan according to claim 3, wherein the by-pass duct, between the intake duct and the discharge exit, covers a distance that is as short as possible.

9. A fan according to claim 8, wherein the by-pass duct extends in the proximity of the lateral duct of the ring-duct fan.

* * * * *